US007523992B1

(12) United States Patent
Yang

(10) Patent No.: US 7,523,992 B1
(45) Date of Patent: Apr. 28, 2009

(54) MECHANISMS FOR FLEXIBLY SECURING J-BAR TO CHAIR BACKREST AND CHAIR HEADREST RESPECTIVELY

(75) Inventor: Teng-Chiang Yang, Taichung (TW)

(73) Assignee: Da Yin Wei Tong Co., Ltd., Taichung (TW)

( * ) Notice: Subject to any disclaimer, the term of this patent is extended or adjusted under 35 U.S.C. 154(b) by 0 days.

(21) Appl. No.: 11/958,385

(22) Filed: Dec. 18, 2007

(51) Int. Cl.
*A47C 31/00* (2006.01)

(52) U.S. Cl. ..... 297/463.1; 297/463.2; 297/353; 297/451.1

(58) Field of Classification Search ..... 297/463.1, 297/463.2, 353, 391, 440.2, 451.1
See application file for complete search history.

(56) References Cited

U.S. PATENT DOCUMENTS 252,980 A * 1/1882 Tonk et al. ..... 297/298
849,596 A * 4/1907 Budd ..... 297/463.2
2,784,769 A * 3/1957 Fisher ..... 297/451.1
2,796,920 A * 6/1957 Cowles ..... 297/291
3,059,971 A * 10/1962 Becker ..... 297/353
3,583,759 A * 6/1971 Kramer ..... 297/451.1
6,565,155 B1 * 5/2003 Huang ..... 297/353
6,626,494 B2 * 9/2003 Yoo ..... 297/296
6,945,601 B1 * 9/2005 Wu ..... 297/284.4

* cited by examiner

*Primary Examiner*—Laurie K Cranmer

(57) ABSTRACT

Provided is a plastic fastening mechanism including an intermediate main body having an axial, shouldered first through hole, two wings each having an axial, shouldered second through hole, and two flexible interconnections each formed between the wing and the main body; and elastomeric first and second elements each shaped to conform to the rear of either the first or second member. The main body is threadedly secured to a chair J-bar and the wings are threadedly secured to chair backrest. The main body of each of another two plastic fastening mechanisms is threadedly secured to the J-bar, and the wings thereof are threadedly secured to chair headrest. Moreover, there are provided two elastomeric mechanisms shaped to conform to the rears of the fastening mechanisms. The elastomeric mechanism includes an intermediate, hollow member, two side receptacles, and second interconnections each formed between the hollow member and either receptacle.

3 Claims, 4 Drawing Sheets

MECHANISMS FOR FLEXIBLY SECURING J-BAR TO CHAIR BACKREST AND CHAIR HEADREST RESPECTIVELY

BACKGROUND OF THE INVENTION

1. Field of Invention

The invention relates to a backrest of a chair, stool, or the like and more particularly to two fastening mechanisms for flexibly securing a J-bar to chair backrest and chair headrest respectively with improved characteristics including lessening the effect of jarring and effectively relieving stress of the spine of a seat person and thus providing an increased degree of comfort to the person.

2. Description of Related Art

Backrest is an important component of a chair since a well designed backrest can provide a degree of comfort to a seat person. There have been numerous suggestions in prior patents for chair backrest. For example, U.S. Pat. No. 5,195,804 discloses a chair having two oval shaped shells each concave to vertical and convex to horizontal. Also, PCT Patent Application WO91/18539 discloses a backrest. Both patents aim at effectively relieving stress of the spine of a seat person.

However, the devices shown in the prior art are complex in structure, are subject to malfunction, and are cost ineffective. Moreover, so far as the inventor is aware, the conventional devices have had no market acceptance. Thus, continuing improvements in the exploitation of chair backrest are constantly being sought.

SUMMARY OF THE INVENTION

It is therefore one object of the invention to provide fastening mechanisms for flexibly securing a J-bar to chair backrest and chair headrest respectively with improved characteristics including lessening the effect of jarring and effectively relieving stress of the spine of a seat person and thus providing an increased degree of comfort to the person.

To achieve the above and other objects, the invention provides a fastening device, comprising plastic first and second members each including an intermediate main body having an axial, shouldered first through hole, two wings each having an axial, shouldered second through hole, and two flexible first interconnections each formed between the wing and the main body; and elastomeric first and second elements each shaped to conform to the rear of either the first member or the second member; wherein the main body of the first member is adapted to threadedly secure to a vertically stationary upright backrest support of a chair, the wings of the first member are adapted to threadedly secure to a backrest of the chair, the main body of the second member is adapted to threadedly secure to the vertically stationary upright backrest support of the chair, and the wings of the second member are adapted to threadedly secure to a headrest of the chair.

In one aspect of the invention each of the first and the second elements comprises an intermediate, hollow member, two side receptacles, and second interconnections each formed between the hollow member and either receptacle.

The above and other objects, features and advantages of the invention will become apparent from the following detailed description taken with the accompanying drawings.

DETAILED DESCRIPTION OF THE INVENTION

Figure 1:
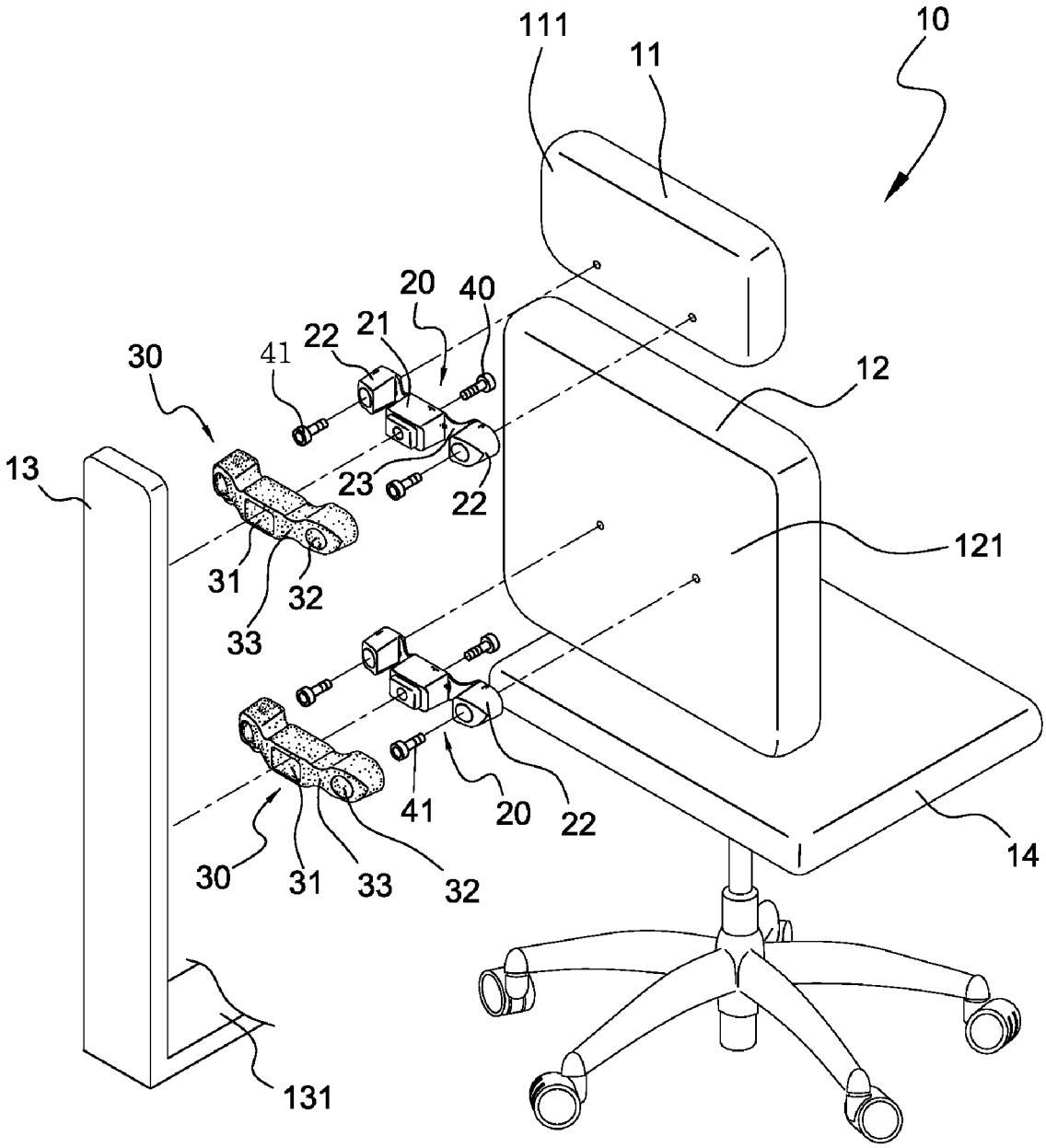
FIG. 1 is an exploded view of a backrest, a headrest, a J-bar, resilient mechanisms, and fastening mechanisms both according to a preferred embodiment of the invention to be assembled with the backrest, the headrest, and the J-bar to form a complete chair.
Figure 2:
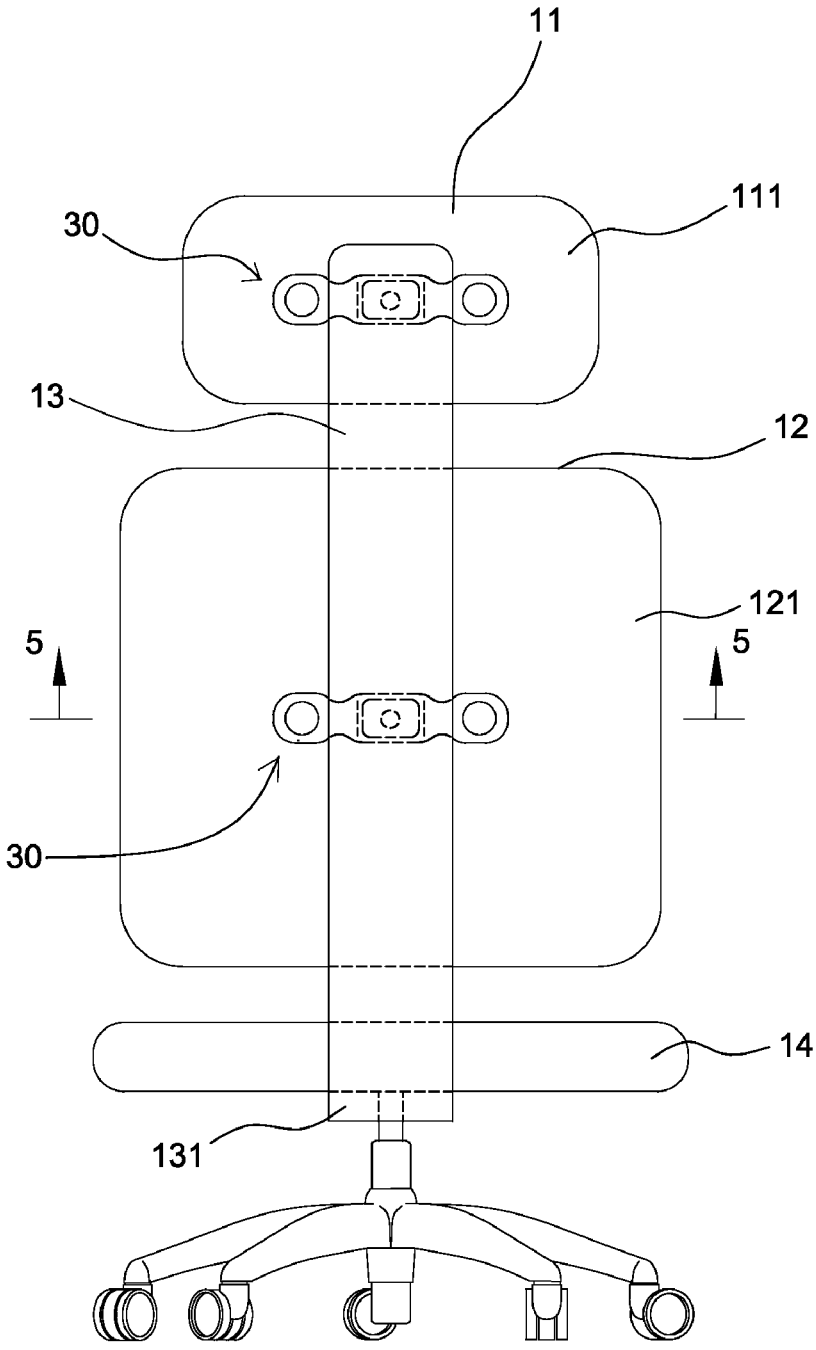
FIG. 2 is a rear view of the assembled chair.
Figure 3:
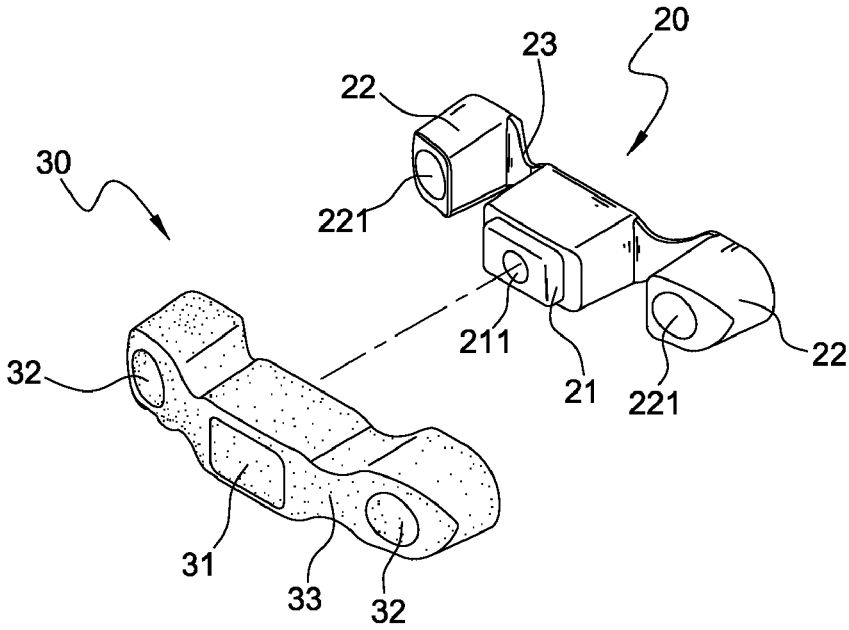
FIG. 3 is an enlarged view of the fastening mechanism shown in FIG. 1.
Figure 4:
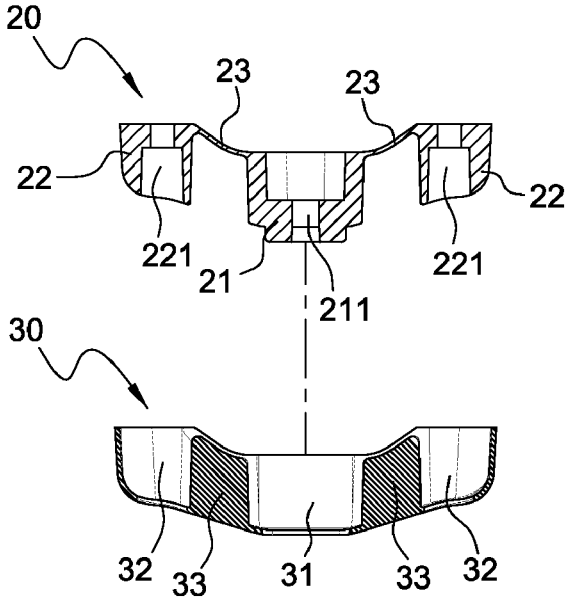
FIG. 4 is a transverse sectional view of FIG. 3.
Figure 5:
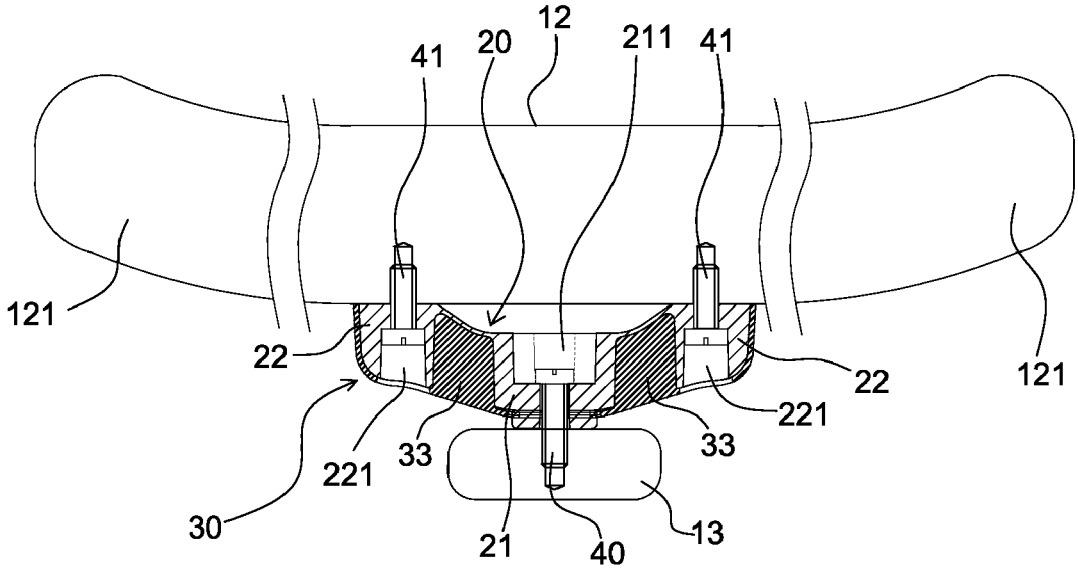
FIG. 5 is a sectional view taken along line 5-5 of FIG. 2.

Referring to FIGS. 1 to 5, a chair 10 incorporates a preferred embodiment of the invention is shown. The chair 10 comprises a seat 14 attached to a wheeled supporting framework (not numbered), a backrest 12, a headrest 11, a vertically stationary upright backrest support or J-bar 13 having a horizontal part 131 secured to the underside of the seat 14, and first and second fastening mechanisms 20.

The fastening mechanism 20 is formed of a plastic having characteristics including flexibility and sturdiness. The fastening mechanism 20 is a transversely extended member and comprises an intermediate main body 21 having an axial, shouldered through hole 211, two side wings 22 having an axial, shouldered through hole 221, and two slightly bent, thin interconnections 23 each formed between the wing 22 and the main body 21.

In a first configuration of assembly, a first fastener (e.g., screw) 40 is driven through the through hole 211 of the first fastening mechanism 20 into an intermediate portion of the vertical part of the J-bar 13 and two second fasteners (e.g., screws) 41 are driven through the through holes 221 of the first fastening mechanism 20 into a back 121 of the backrest 12 respectively. Further, another first fastener (e.g., screw) 40 is driven through the through hole 211 of the second fastening mechanism 20 into an upper portion of the vertical part of the J-bar 13 and two second fasteners (e.g., screws) 41 are driven through the through holes 221 of the second fastening mechanism 20 into a back 111 of the headrest 11 respectively. This completes assembly of the chair 10.

It is contemplated by the invention that the fastening mechanisms 20 can lessen the effect of jarring and effectively relieve stress of the spine of a seat person and thus provide a degree of comfort to the seat person.

The chair 10 further comprises first and second resilient mechanisms 30. The resilient mechanism 30 is shaped to conform to the rear surface of the fastening mechanism 20. In detail, the resilient mechanism 30 is formed of an elastomer. The resilient mechanism 30 is a transversely extended member and comprises an intermediate, hollow member 31, two side receptacles 32, and two interconnections 33 each formed between the receptacle 32 and the hollow member 31.

In a second configuration of assembly, put the resilient mechanisms 30 on the fastening mechanisms 20 from rear to assemble as an integrated structure. Next, assemble the fastening mechanisms 20 with the backrest 12, the headrest 11, and the J-bar 13 as described above in which the first fastener 40 is driven through the through hole 211 of the first fastening mechanism 20 and the hollow member 31 into the intermediate portion of the vertical part of the J-bar 13.

It is envisaged by the invention that the resilient mechanisms 30 together with the fastening mechanisms 20 can further lessen the effect of jarring and further effectively relieve stress of the spine of a seat person and thus provide an increased degree of comfort to the seat person.

While the invention herein disclosed has been described by means of specific embodiments, numerous modifications and variations could be made thereto by those skilled in the art without departing from the scope and spirit of the invention set forth in the claims.

What is claimed is:

1. A fastening device, comprising:

plastic first and second members each including an intermediate main body having an axial, shouldered first through hole, two wings each having an axial, shouldered second through hole, and two flexible first interconnections each formed between the wing and the main body; and elastomeric first and second elements each shaped to conform to a rear of either the first member or the second member, wherein the main body of the first member is adapted to threadedly secure to a vertically stationary upright backrest support of a chair, the wings of the first member are adapted to threadedly secure to a backrest of the chair, the main body of the second member is adapted to threadedly secure to the vertically stationary upright backrest support of the chair, and the wings of the second member are adapted to threadedly secure to a headrest of the chair.

2. The fastening device of claim 1, wherein each of the first and the second elements comprises an intermediate, hollow member and two side receptacles.

3. The fastening device of claim 2, wherein the hollow member comprises two extended second interconnections formed with either receptacle.

* * * * *